US008161887B2

(12) United States Patent
Cardoni

(10) Patent No.: US 8,161,887 B2
(45) Date of Patent: Apr. 24, 2012

(54) SYSTEM FOR MOVING AND STABILISING A MOBILE BASE

(75) Inventor: Patrizio Cardoni, Bologna (IT)

(73) Assignee: SMV S.r.l., Corridonia (Macerata) (IT)

( * ) Notice: Subject to any disclaimer, the term of this patent is extended or adjusted under 35 U.S.C. 154(b) by 294 days.

(21) Appl. No.: 12/529,266

(22) PCT Filed: Mar. 4, 2008

(86) PCT No.: PCT/IB2008/000477

§ 371 (c)(1),
(2), (4) Date: Aug. 31, 2009

(87) PCT Pub. No.: WO2008/107770

PCT Pub. Date: Sep. 12, 2008

(65) Prior Publication Data

US 2010/0031845 A1 Feb. 11, 2010

(30) Foreign Application Priority Data

Mar. 8, 2007 (IT) ..... BO2007A0154

(51) Int. Cl.
*B61B 13/04* (2006.01)

(52) U.S. Cl. ..... 104/118; 104/34; 104/37; 105/72.2

(58) Field of Classification Search ..... 104/35, 104/45, 48, 99, 288, 295, 242, 245, 246, 104/247; 105/30, 32, 33, 72.2
See application file for complete search history.

(56) References Cited

U.S. PATENT DOCUMENTS 3,212,654 A * 10/1965 Dolphin ..... 414/341
(Continued)

FOREIGN PATENT DOCUMENTS

DE 3115479 A1 10/1982
(Continued)

OTHER PUBLICATIONS

International Search Report.

*Primary Examiner* — S. Joseph Morano
*Assistant Examiner* — Jason C Smith
(74) *Attorney, Agent, or Firm* — Wiliam J. Sapone; Coleman Sudol Sapone P.C.

(57) ABSTRACT

The system for moving and stabilizing (1) moves and stabilizes a mobile base (10), which is part of a robotic unit (100) for handling which is designed to move objects in an automated shop or an automated warehouse (200). The system (1) comprises: a linear guide element (5), which guides the mobile base (10) along operating trajectories; at least one rotatable shunting element (6), arranged at an end of the guide element (5) and designed to connect two or more guide elements (5) to one another, in order to shunt the mobile base (10) among various linear guides (5), or to enable the mobile base (10) to re-engage with the linear guide (5), with a modified orientation thereto; traction and positional control organs (20), arranged in a lower part of the mobile base (10) and designed to guide the mobile base along the guide elements (5) and shunting elements (6); stabilizer organs (30), arranged peripherally in the lower part of the mobile base (10) and destined to stabilize a position thereof during operations of handling of objects by the robotic unit (100). The mobile base (10) and the shunting element (6) are controlled by a computerised control unit, which manages the operations on the basis of the operating requirements of the automated shop or store (100).

26 Claims, 3 Drawing Sheets

U.S. PATENT DOCUMENTS

| | | | | | |
|---|---|---|---|---|---|
| 3,255,899 | A | * | 6/1966 | Mengel | 414/303 |
| 3,800,963 | A | * | 4/1974 | Holland | 414/279 |
| 4,007,843 | A | * | 2/1977 | Lubbers et al. | 414/273 |
| 4,119,208 | A | * | 10/1978 | Acker | 211/59.2 |
| 4,298,305 | A | * | 11/1981 | Neth | 414/498 |
| 4,505,630 | A | * | 3/1985 | Kaschner et al. | 414/152 |
| 4,553,893 | A | * | 11/1985 | Kaschner et al. | 414/152 |
| 4,941,794 | A | * | 7/1990 | Hara et al. | 414/341 |
| 4,971,507 | A | * | 11/1990 | Weggelaar | 414/279 |
| 6,042,321 | A | * | 3/2000 | Labell | 414/276 |
| 6,652,213 | B1 | * | 11/2003 | Mitchell et al. | 414/284 |
| 2010/0031845 | A1 | * | 2/2010 | Cardoni | 104/118 |

FOREIGN PATENT DOCUMENTS

| | | | |
|---|---|---|---|
| EP | 0276651 | A | 8/1988 |
| EP | 0458722 | A | 11/1991 |
| JP | 04333402 | A | 11/1992 |
| WO | WO2007/007354 | A | 8/2009 |

* cited by examiner

FIG. 4
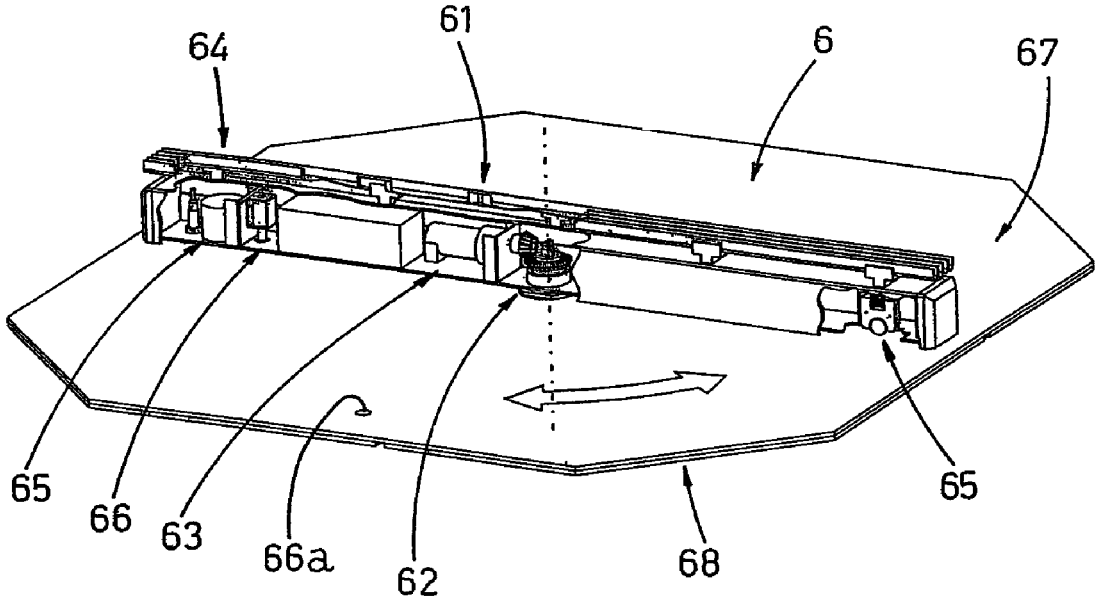
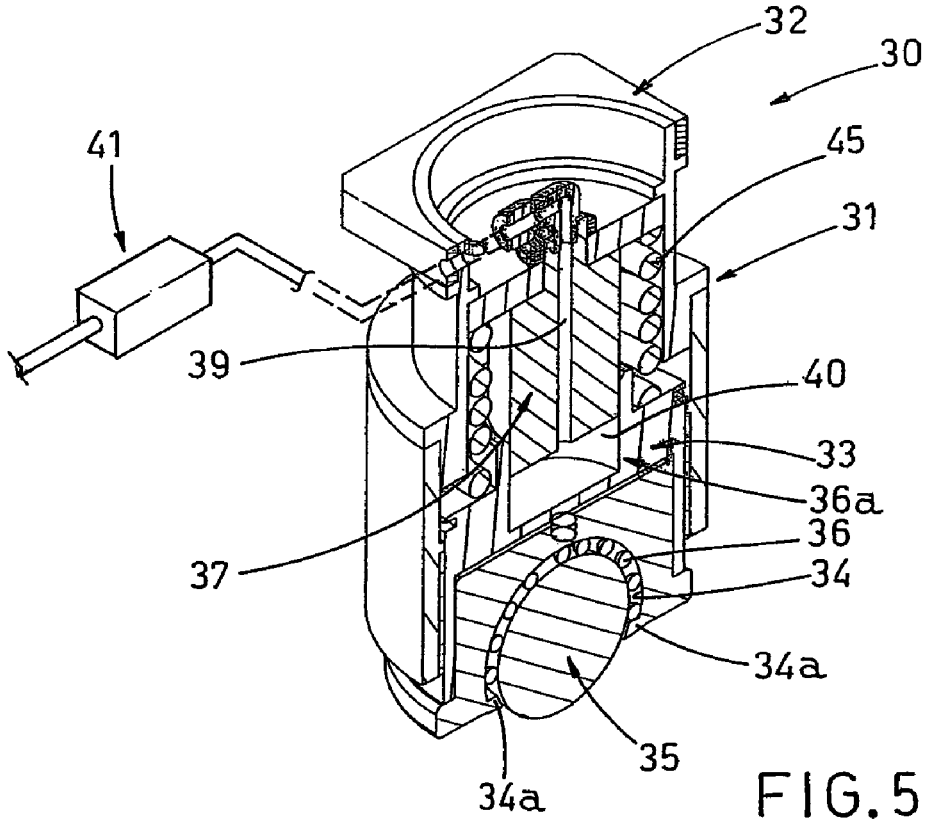
FIG. 5

SYSTEM FOR MOVING AND STABILISING A MOBILE BASE

TECHNICAL FIELD

This invention concerns the technical sector relative to apparatus and devices for automated handling of objects.

In particular, the invention concerns a system for handling and stabilising a mobile base, for example designed to serve as a platform for a robotic unit for handling and transferring objects.

BACKGROUND ART

It is known that the handling of objects in industrial, logistics, and automated vending fields is generally managed by computerised systems for receiving/storing and retrieving/dispensing (ASR—automatic storage and retrieval) systems which, among other things, comprise robotic units for handling objects.

In large or medium-sized systems these units can be mounted on self-propelled bases; in small-sized systems they can be made mobile by means of arms which are controlled throughout different degrees of freedom, or other known controlled movement modalities. Various types of automatic dispenser designed for vending and renting objects of generally small dimensions (pharmaceuticals, snacks, video cassettes, DVDs and the like) belong to the category of ASR systems for small-sized objects.

There are two main known techniques for moving and piloting robotic units for handling and conveying, which are mounted on self-propelled bases. The first consists of making the units follow predetermined trajectories which a processor controlling the unit recognises by means of suitable sensors that are capable of detecting a signal produced by a guide arranged on the floor, or embedded in it. The signal can for example be of an optical type, and in this case the guide consists of a line obtained with particularly reflective paint; or of an electric type, in which case the corresponding guide consists of a conducting cable embedded in the floor, or of a strip of conductive material arranged on the floor surface.

The bases are provided with drive wheels and stabiliser devices. Operation of the drive wheels is in general precisely controllable by the unit processor, which can command synchronous rotation to obtain rectilinear motion, differentiated motion to achieve curved trajectories, or, if required, counter-rotation to enable the unit to rotate about its own vertical axis. Position stabilisers are usually constituted by pivoting, and possibly shock-absorbing, wheels.

Controlling these robotic units is a particularly complex and expensive task to achieve, and their positioning may possibly not be sufficiently precise when objects of very small dimensions must be identified, handled and repositioned.

Another known technique for piloting robotic handling and conveying units makes use of predetermined trajectories constituted by tracks which are constrained to the floor. In this case, the base of the unit is guided by the tracks and control over movements is limited to adjusting the speed and defining the direction of the movement.

Units of this type are however obliged to follow the trajectories defined by the tracks. Access to storage locations which are arranged facing each other requires the handling organs to be capable of operating on either side of the locations, for example using telescopic small forks or belts, or at least to be provided with a rotating base, capable of orienting the handling organs relative to the direction of the tracks. All of the aforesaid entails a high level of complexity for the mechanical organs of the robotic unit, with a consequent increase in production costs. Further, to obtain changes of direction of the robotic unit, curved guide elements having a curve radius of 3-4 meters may be used. This also increases the space which cannot be used for storing the objects.

The aim of this invention is to provide a system for moving and stabilising a mobile base of a robotic unit which enables the unit to move easily in the corridors between the shelving, to rotate around itself and also to move between different branches of the storage structure.

A further aim of the invention is to provide a system for moving and stabilising, which enables complex and modular storage structures to be constructed.

A further aim of the invention is to stabilise the robotic unit effectively when it has to stop in order to perform precise operations for recognising spaces or objects, and for handling the objects.

A still further aim of the invention is to provide a system for moving and stabilising which enables various robotic units to coexist in the same storage structure.

DISCLOSURE OF INVENTION

The aforementioned aims are entirely achieved, in accordance with the contents of the claims, by a system for moving and stabilising a mobile base which is part of a robotic handling unit, which is designed to move objects in an automated shop or in an automated warehouse.

The system comprises: a linear guide element, for guiding the mobile base along suitable operating trajectories; at least one rotatable shunting element, arranged at an end of the guide element and designed to reciprocally connect two or more guide elements, in order to shunt the mobile base between different linear guide elements, or to enable the mobile base to newly engage the previous differently-oriented linear guide element; traction and positional control organs, arranged in the lower part of the mobile base and designed to convey the mobile base along the guide elements and shunting elements; stabiliser organs, peripherally arranged in the lower part of the mobile base and designed to stabilise its position during the object handling operations of the robotic unit.

The mobile base and the shunting element are controlled by a computerised control unit, which manages their operations according to the operating requirements of the automated shop or warehouse.

BRIEF DESCRIPTION OF THE DRAWINGS

As will become clear from the claims, the characteristics of the invention are highlighted in the following detailed description, with reference to the appended tables of drawings, in which:

FIG. 4 illustrates a perspective view of the finger of FIG. 3, viewed from another angle;

FIG. 5 illustrates a perspective view of a portion of the finger of FIG. 3.

BEST MODE FOR CARRYING OUT THE INVENTION

Figure 1:
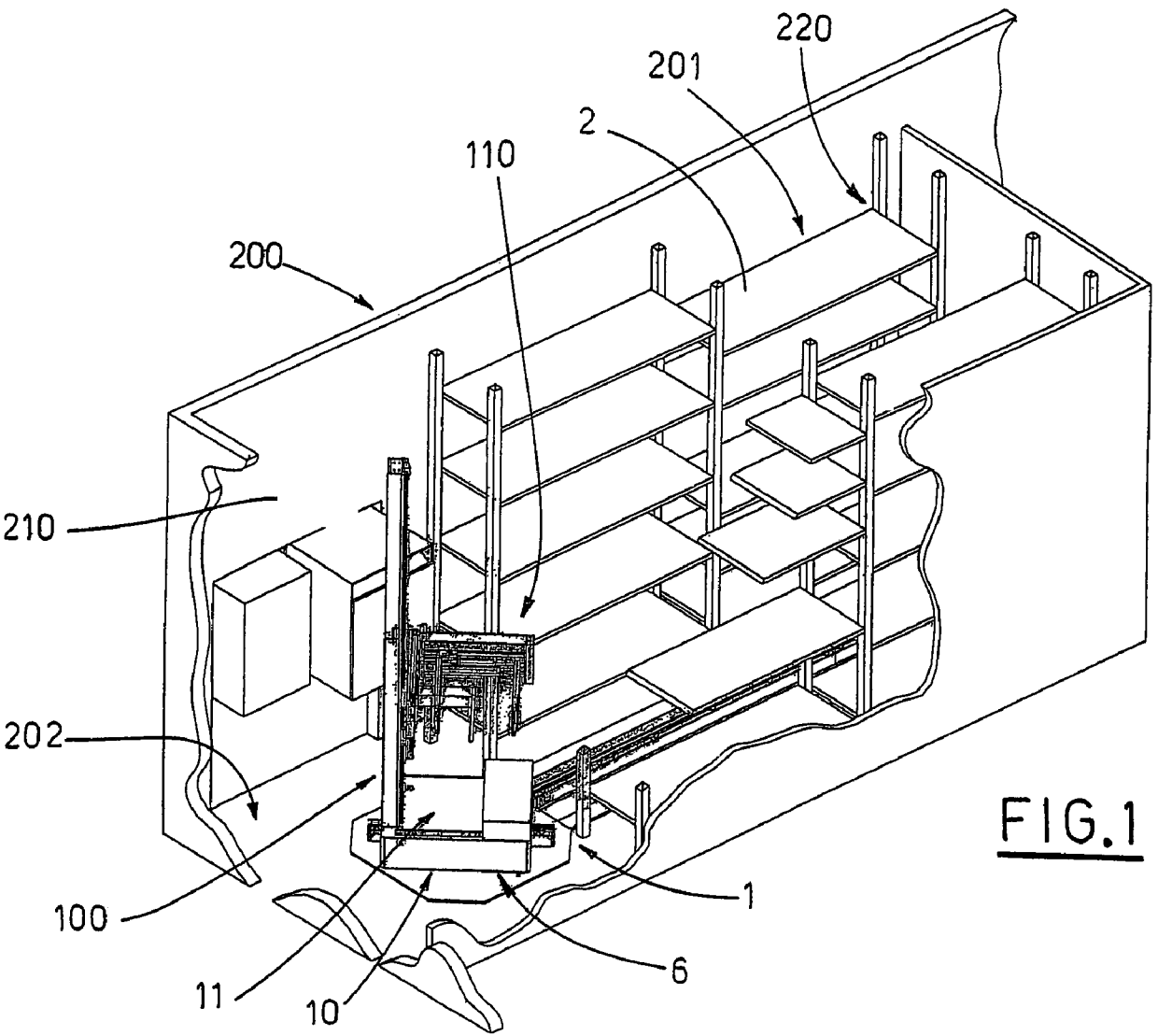
FIG. 1 illustrates a perspective view of an automated vending system comprising the device for identifying, collecting and repositioning objects which implements the method of the invention.

In FIG. 1, the number 100 refers to a mobile robotic unit for handling and conveying a plurality of objects, for example in an automated shop 200 or in an automated warehouse. The handling unit 100 comprises a mobile base 10, provided with a platform 11 which supports organs 110 for recognising and handling the objects.

The structure of the organs 110 constitutes the subject of separate patent protection, and is described in detail in a corresponding patent application in the name of the same Applicant.

The vending unit 200 incorporates a system 1 for moving and stabilising the mobile base 10, which system is implemented according to this invention.

As an example, reference will be made herein below to the use of the moving system 1 in an automated shop 200. FIG. 1 illustrates a possible configuration of the shop, which is constituted by a unit 210 for receiving and dispensing the objects, by a plurality of storage units 201 formed by shelving 220, which is suitably arranged on the basis of the available space and the possibilities for moving the handling and conveying unit 100, and by the moving and stabilising system 1, which extends longitudinally in relation to the extension of the shelving 220. The example of configuration shown in FIG. 1 is intentionally rather basic, but the structure of the shelving 220, and consequently of the system for moving 1, can be much more complex and articulated, extending to a number of rows which may be parallel to, or divergent from, one other, or may extend in a grid fashion, according to the size and layout of the premises where they are installed.

The shelving 220 provides support surfaces 2 for the objects which define a series of housings of different heights, which optimally receive objects having different bulk, rigidity and weight.

Figure 2:
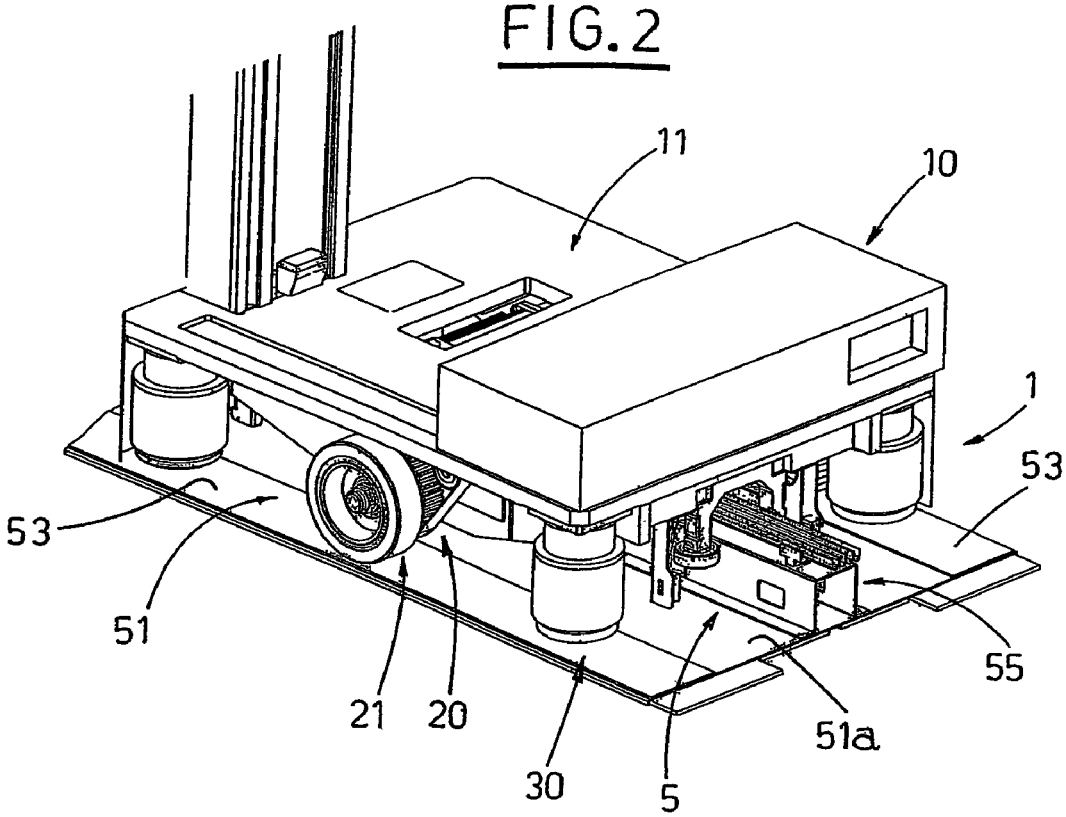
FIG. 2 illustrates a perspective view of a mobile handling and conveying unit which is a part of the system of FIG. 1, and which incorporates the device for identifying, collecting and repositioning objects.

The handling and conveying unit 100 (see also FIG. 2) comprises a mobile, self-stabilising base 10 which is controlled by a computer which allows the unit 100 to access all the support surfaces 2 of the shop and the receiving and dispensing unit 210.

The position of the objects on the relative support surfaces 2, together with general positional information about the objects and management strategies for stocking the shop and selling the objects, are managed by an external processor using substantially known techniques and modalities, which however go beyond the scope of this invention.

The system 1 comprises, in particular, one or more modular linear guide elements 5, which are fixedly mounted on a support surface 202 of the shop 200, for example the floor. The guide element 5 is designed to guide the mobile base 10 along an operating trajectory concerning the storage units 201, on command of a central processor through a local computerised control unit. In FIG. 1, a single guide element 5 is shown, as the shop 200 floor plan represented is simple.

Figure 3:
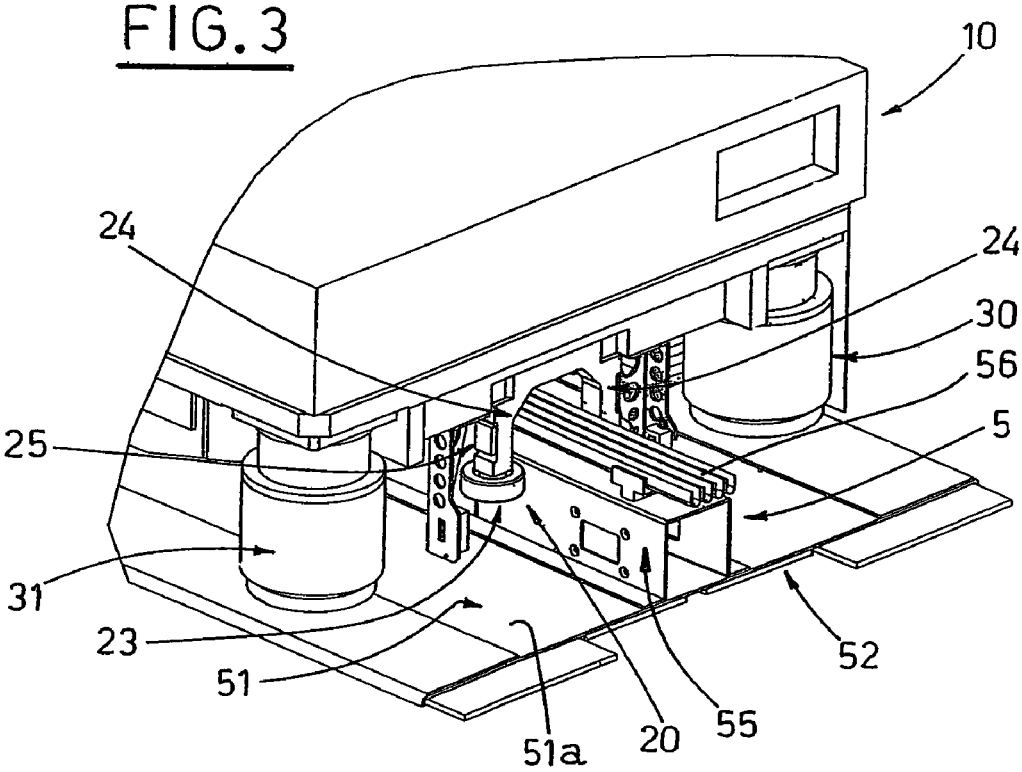
FIG. 3 illustrates a partially cutaway perspective view of a finger of the mobile gripper device belonging to the identifying device.

Each guide element 5 comprises a structural plane 51 (see FIGS. 2 and 3) which extends longitudinally, is arranged resting on the floor 202, and provides a substantially level movement surface for the mobile base 10.

The structural plane 51 in turn comprises an upper layer 51*a* made of sheet metal, and a lower layer 52 made of a compressible polymer material having a high friction coefficient. In particular, the lower layer 52 is preferably constituted by two layers of polymer material having different characteristics. An inner layer, which is in contact with the upper layer 51, is less compressible and is better suited to supporting concentrated loads, while an outer layer is more compressible and has a higher friction coefficient, and further, compensates for anomalies in the planarity of the floor 202 upon which it rests.

The structural plane 51 further comprises a pair of rolling tracks 53, which are arranged longitudinally at the sides of the structural plane 51, and are made with reinforced metallic material to perform functions which will become clear later in the description.

The linear guide element 5 further comprises a monorail profile 55, constrained longitudinally to the structural plane 51 and designed to guide the mobile base 10 in a movement direction thereof. The monorail guide 55, in the embodiment illustrated in the figures, is made using a metal section bar having a quadrangular cross-section, and is centrally arranged on the structural plane 51.

The upper surface of the monorail guide 55 supports a linear power supply distributor 56, which supplies electric power to the mobile base 10. This distributor 56, which is preferably of a substantially known type having drag brushes, supplies power continuously and efficiently.

The system 1 further comprises one or more rotatable shunting elements 6 (see FIG. 4), which are also arranged resting on the floor 202 and reciprocally connect two or more of the linear guide elements 5 described above. They provide guiding continuity for the mobile base 10, which can engage with them after having left the linear guide elements 5, in order then to be shunted towards another guide element 5, or to be rotated by 180°, and subsequently return to the original guide element 5 oriented facing a shelving located on the opposite side to the guide element 5.

On command of the control processor, the shunting element 6 rotates, whether it is empty or carrying the mobile base 10. Each shunting element 6 comprises a segment of monorail profile 61 mounted rotatably around a central hub 62 on a portion of structural plane 67, which structural plane 67 is arranged resting on the floor 202.

The portion of structural plane 67 is provided by a shaped plate of suitably thick sheet metal which, constrained to its surface facing the floor 202, bears a lower layer 67 made of compressible polymer material with a high friction coefficient. In particular, the lower layer can be made like the lower layer of the structural plane 52 of the above-described linear guide element 5.

The segment of monorail profile 61 also exhibits a hollow, quadrangular cross-section. Within the monorail profile 61 a gear reducer group 63 is provided, which is mechanically linked to the hub 62 by means of a crown wheel and pinion group, designed to make the monorail profile 61 rotate on the hub 62. In particular, as the following description will make clear, the gear reducer group 63 rotates the monorail segment 62 when the monorail segment 62 is free, that is when the handling unit 100 is not engaged with it; such rotations become necessary, for example, in order to vary the connections between different linear guide elements 5 leading to the same shunting element 6. If a handling unit is engaged to the shunting element 6, and needs to rotate for any reason, it will preferably do so using its own means, as the rest of the description will make clear.

The gear reducer 63 is also provided with a positional control device, which is not illustrated since it is of known type, for example an encoder connected to the control processor of the handling unit and/or the external management processor of the entire structure, in order to inform the processors about the exact angular position assumed by the monorail segment 62. This is particularly important when the handling unit is engaged in rotating the shunting element 6. In this case, thanks to the information received from the positional control device of the gear reducer 63, it can at any time be aware of its own angulation with respect to all the linear guide elements leading to the shunting element 6.

Further, at the upper surface of the monorail profile 61, a segment 64 of linear power supply distributor is provided, which provides power to the mobile base when the mobile base is engaged with the shunting element 6, and disengaged from the linear guide elements 5. The distributor segment 64 is shaped exactly like the distributor 56 provided in the linear guide element 5, and is continuous with the linear guide element 5 when the shunting element 6 is aligned there-with.

At the ends of the segment of monorail profile 61, a pair of sliding ball-bearing groups 65 is mounted, which are arranged with the balls in contact with the floor 202, and which are designed to support the profile 61 and facilitate its movements of rotation.

An electromagnetic bolt 66 is also provided inside the monorail profile, which bolt 66 is electrically connected to the control unit and can be activated by the control unit to engage, when the profile 61 is in predetermined operating positions, in corresponding holes 66*a* which are afforded in the portion of structural plane 67.

The system 1 further comprises drive and positional control organs 20 of the mobile base 10 which are arranged in the lower part of the mobile base 10 and lead the mobile base 10 on the operating trajectories along the guide elements 5 and shunting elements 6.

In particular, the drive and positional control organs comprise a pair of drive wheels 21, mounted on the lower part of the mobile base 10 in symmetrical positions with respect to the axis of rotation of the mobile base. The drive wheels 21 are powered independently of each other by means of position- and torque-controlled motors, for example brushless motors, controlled in a known way by the control unit. Therefore the drive wheels 21 can be activated in the same direction and at the same speed, in either direction, to move the mobile base 10 forwards or backwards; they can be operated in opposite directions to enable the base 10 to rotate about its own axis, for example when the mobile base 10 is on a shunting element 6; or they can be operated with minimal speed differences to control the exact position of the base 10 and compensate for any deviations from the optimal advancement position.

The optimal position is defined by position control organs, comprising two pairs of guide wheels 23 and sensor means 25.

The guide wheels 23 are rotatably mounted in pairs on the lower part of the mobile base 10, and are horizontal and idle on respective supports 24, which extend downwardly from the lower surface of the mobile base 10. The guide wheels 23 are arranged on opposite sides of the monorail profile 55, and rest against the lateral surfaces of the monorail profile 55. The two pairs of guide wheels 23 are conveniently arranged at a distance from each other, respectively in the front part and rear part of the base 10 and aligned with the monorail profile 55, in such a way that they keep the base 10 substantially aligned with the monorail profile 55.

The sensor means 25 detect any deviations in the position of the mobile base 10 from the optimal position of alignment with the monorail profile 55. Preferably, for each guide wheel 23, the sensor means 25 comprise an extensometer which detects the load of the guide wheels 23 on the monorail profile 55, by measuring the deformation of the support 24 of the guide wheels. This enables the control unit of the mobile base 10 to correct deviations from the ideal trajectory, simply by modifying the speed of each of the drive wheels in order to minimise the angular error of the trajectory. This enables all the mechanical parts of the mobile base 10 to be advantageously designed with dimensional tolerances that are not particularly tight, thus containing design and production costs.

Further sensors of the photoelectric, laser or other type can be provided to contribute in a known way to better defining the deviations of the base 10 from the optimal position thereof, thus enabling the control unit to compensate for them by acting on the drive wheels 21.

At the corners of the mobile base 10 the system 1 exhibits stabiliser organs 30, designed to stabilise the position of the mobile base 10 during the operations of recognising and handling objects which the robotic unit 100 performs.

The stabiliser organs 30 are constituted by four lockable feet with ball bearings s arranged on the lower part of the mobile base 10, at the corners thereof.

Each ball bearing lockable foot 30 (see also FIG. 5) consists of an internally hollow body 31 of a substantially cylindrical shape, which is provided in its upper part with a flange 32 which enables it to be constrained to the lower surface of the mobile base 10.

Within the body 31, a cylindrically symmetrical mobile block 33 is provided, the lower part of which affords a semi-spherical cavity 34. The semi-spherical cavity 34 receives a support sphere 35 of large dimensions, which rolls within the cavity 34 with the interposition of a plurality of small-diameter rolling balls 36. Further, projecting elements 34*a* are provided in the internal mobile block 33, which prevent the rolling balls from escaping from the cavity 34. The upper part of the mobile block 33 is internally hollow.

A cylindrically symmetric internal block 37, which is mounted coaxial with the body 31 and with the mobile block 33, is constrained to the upper part of the body 31. The lower part of the fixed internal block 37 is slidingly inserted in the hollow upper part 36*a* of the mobile block 33, thus defining a compensation chamber 40 having variable volume. The fixed block 37 further affords a through axial conduit 39 which opens into the compensation chamber 40.

In addition, in the upper part of the body 31, a compressible coil spring 45 is mounted coaxially with the fixed internal block 37 and operates in contrast with the mobile internal block 33.

The compensation chamber 40 is designed to receive hydraulic fluid, which is supplied through the axial conduit 39 by an accumulation tank (not illustrated), which supplies the liquid and receives the liquid within itself, respectively as a consequence of increases or diminutions in the volume of the compensation chamber 40. These variations are due to the excursions of the mobile block 33 caused by corresponding variations of load on the ball-equipped foot 30, by effect of the centre of gravity of the mobile base 10 shifting during the object handling operations.

In this connection, the axial conduit 39 fluidly communicates with the accumulation tank with the interposition of a check valve 41, which is illustrated only schematically in FIG. 5 and is activated by electromagnetic means. The check valve is electrically connected to the control unit and can be operated by the control unit to set the volume of the compensation chamber 40. In this way, the position of the mobile internal block 33, and thus the overall height of the foot 30 with the ball bearing are also set.

In this way, once the robotic unit 100 has reached a predetermined operating position, the mobile base can be stably blocked in this position, to enable the handling organs to perform the operations of recognising and collecting the objects in an extremely precise way.

As already stated, the system 1 is modular so that it can adapt to all the possible dimensional and structural requirements of the premises where the automated shop or store is installed.

In general, it comprises a plurality of the above-mentioned linear guide elements 5, connected to one another by means of a plurality of shunting elements 6.

As a general rule, in the layout of the shop or store, there will be a monorail guide element 230 parallel to each linear shelving structure 220, and suitable connecting devices between the different elements to allow the handling and conveying unit 100 to move throughout the whole area of the shop or warehouse.

The system of the present invention provides multiple advantages. In the first place it allows contemporaneous use of a number of robotic units on a same storage structure, since the various units can be distributed throughout the nodes of the guide structure by means of the shunting elements 6.

Further the robotic units can be made to perform handling operations in a very simple and effective way on both sides of the storage structure.

A further advantage is the remarkable precision which the drive and positional control devices described above provide for guiding and positioning the mobile base.

Another advantage is that the position of the base guide, and thus that of the robotic unit, can be made particularly stable.

Another advantage is that the structural plane thus obtained makes it possible to arrange the entire guide structure resting on the floor 202, without damaging the integrity of the floor 202.

The above description is intended purely as a non-limiting example. Thus, possible modifications to and variants of the invention are considered to fall within the ambit of protection granted to this technical solution, as described above and claimed below.

The invention claimed is:

1. A system for moving and stabilizing a mobile base, which mobile base is part of a robotic handling unit (100) for moving objects in an automated shop or an automated warehouse (200) containing a plurality of storage units (201) for storing the objects, the mobile base having a platform (11) which supports devices for recognizing and handling the objects, the system comprising:

at least one modular linear guide element (5), which is mounted on a support surface (202) of the automated shop or the automated warehouse (200), and which guides the mobile base (10) along an operating trajectory which tracks with the plurality of storage units (201);

at least one rotatable shunting element (6), arranged on the support surface (202) at an end of the at least one modular linear guide element (5) and designed to reciprocally connect the at least one modular linear guide element with two or more additional linear guide elements (5), each additional linear guide element arranged at a predetermined angle relative to one another, the at least one rotatable shunting element receiving the mobile base thereon and being rotatably alignable with a selected linear guide element in order to shunt the mobile base (10) between the at least one modular linear guide element and the selected one of the two or more additional linear guide elements (5), or to enable the mobile base (10) to newly engage the at least one modular linear guide element at a different orientation thereto;

traction and positional control organs (20), arranged in a lower part of the mobile base (10), which convey the mobile base (10) along the linear guide elements (5) and the shunting element (6), for positioning the mobile base (10);

stabilizer devices (30), arranged peripherally in a lower part of the mobile base (10), which stabilize the position thereof during handling of the object by the robotic handling unit (100);

the mobile base (10) and shunting element (6) being controlled by a computerized control unit, which controls the positioning and stabilization of the mobile base according to operating requirements of the automated shop or the automated warehouse; and, wherein each linear guide element (5) has a structural plane (51) which is mounted on the support surface (202), providing the mobile base (10) with a substantially level surface on which to move, the structural plate providing a support surface for the stabilizer devices (30), each linear guide element having a monorail profile (55), which is longitudinally mounted on the structural plane (51), the monorail profile guiding the mobile base (10) in a movement direction thereof.

2. The system of claim 1, wherein the structural plane (51) has a lower layer (52) made of a compressible polymer material having a high friction coefficient.

3. The system of claim 1, wherein the structural plane (51) includes a pair of rolling tracks (53) arranged longitudinally at sides of the structural plane (51).

4. The system of claim 1, wherein the monorail profile (55) supports a linear power supply distributor (56) which provides electric power to the mobile base (10).

5. The system of claim 1, wherein the monorail profile (55) has a substantially quadrangular cross-section.

6. The system of claim 1, wherein the shunting element has a rotatable monorail profile (61) arranged horizontally thereon, the rotatable monorail profile being pivoted centrally at a hub (62) having a vertical axis, the rotatable monorail profile (61) receiving the mobile base (10) thereon and then being rotatable about the vertical axis, on command of the control unit.

7. The system of claim 6, wherein the rotatable monorail profile (61) further comprises a gear reducer group (63), which is mechanically connected to the hub (62) for defining rotations of predetermined amplitude of the hub (62) around the vertical axis.

8. The system of claim 7, wherein the rotatable monorail profile (61) supports a linear power supply distributor (64) which supplies electric power to the mobile base (10) when the mobile base (10) is engaged with the shunting element (6).

9. The system of claim 7, wherein the gear motor group (63) is provided with positional control means which continuously monitor an angular position of the rotatable monorail profile (61).

10. The system of claim 6, wherein the rotatable monorail profile (61) supports a linear power supply distributor (64) which supplies electric power to the mobile base (10) when the mobile base (10) is engaged with the shunting element (6).

11. The system of claim 6, wherein the rotatable monorail profile (61) has, near each end thereof, a ball bearing group (65) which slidingly support the rotatable monorail profile (61) to facilitate rotation thereof.

12. The system of claim 6, wherein the rotatable monorail profile has at least one electromagnetic bolt (66), capable of locking the rotatable monorail profile (61) at predetermined positions.

13. The system of claim 1, wherein the stabilizer devices (30) comprise a plurality of excursion lockable ball bearing feet.

14. The system of claim 13, wherein ball bearing feet (30) are provided at each corner of the mobile base (10).

15. The system of claim 14, wherein each of the ball bearing feet (30) comprises:

a body (31) which is internally hollow, superiorly provided with a flange (32) which mounts the body to the lower surface of the mobile base (10);

an internal mobile block (33) inferiorly exhibiting a cavity (34) housing a support sphere (35) with a plurality of rolling balls (36) interposed, an upper part (36*a*) of the mobile block (33) being internally hollow;

an internal fixed block (37), which is mounted coaxially to the body (31) and internally provided with an axial through-conduit (39), a lower part of the fixed internal block (37) being slidingly inserted in the hollow upper part (36*a*), thus defining a compensation chamber (40), which receives hydraulic fluid through the axial through-conduit (39);

a compression spring (45), which is mounted coaxially to the fixed internal block (37) and acts in contrast with the mobile internal block (33).

16. The system of claim 13, wherein each of the ball bearing feet (30) comprises:

a body (31) which is internally hollow, superiorly provided with a flange (32) which mounts the body to the lower surface of the mobile base (10);

an internal mobile block (33) inferiorly exhibiting a cavity (34) housing a support sphere (35) with a plurality of rolling balls (36) interposed, an upper part (36*a*) of the mobile block (33) being internally hollow;

an internal fixed block (37), which is mounted coaxially to the body (31) and internally provided with an axial through-conduit (39), a lower part of the fixed internal block (37) being slidingly inserted in the hollow upper part (36*a*), thus defining a compensation chamber (40), which receives hydraulic fluid through the axial through-conduit (39);

a compression spring (45), which is mounted coaxially to the fixed internal block (37) and acts in contrast with the mobile internal block (33).

17. The system of claim 16, wherein each of the ball bearing feet (30) further comprises a check valve (41) set in fluid communication between the axial through-conduit (39) and a hydraulic fluid accumulation tank, the check valve being operated by the control unit for setting a position of the mobile internal block (33) and for stabilizing the mobile base (10).

18. The system of claim 1, further comprising a plurality of the linear guide elements (5) reciprocally connected by a plurality of the shunting elements (6).

19. A system for moving and stabilizing a mobile base, which mobile base is part of a robotic handling unit (100) for moving objects in an automated shop or an automated warehouse (200) containing a plurality of storage units (201) for storing the objects, the mobile base having a platform (11) which supports devices for recognizing and handling the objects, the system comprising:

at least one modular linear guide element (5), which is mounted on a support surface (202) of the automated shop or the automated warehouse (200), and which guides the mobile base (10) along an operating trajectory which tracks with the plurality of storage units (201);

at least one rotatable shunting element (6), arranged on the support surface (202) at an end of the at least one modular linear guide element (5) and designed to reciprocally connect the at least one modular linear guide element with two or more additional linear guide elements (5), each additional linear guide element arranged at a predetermined angle relative to one another, the at least one rotatable shunting element receiving the mobile base thereon and being rotatably alignable with a selected linear guide element in order to shunt the mobile base (10) between the at least one modular linear guide element and the selected one of the two or more additional linear guide elements (5), or to enable the mobile base (10) to newly engage the at least one modular linear guide element at a different orientation thereto;

traction and positional control organs (20), arranged in a lower part of the mobile base (10), which convey the mobile base (10) along the linear guide elements (5) and the shunting element (6) for positioning the mobile base (10);

stabilizer devices (30), arranged peripherally in a lower part of the mobile base (10), which stabilize the position thereof during handling of the object by the robotic handling unit (100);

the mobile base (10) and shunting element (6) being controlled by a computerized control unit, which controls the positioning and stabilization of the mobile base according to operating requirements of the automated shop or the automated warehouse;

wherein the shunting element has a rotatable monorail profile (61) arranged horizontally thereon, the rotatable monorail profile being pivoted centrally at a hub (62) having a vertical axis, the rotatable monorail profile (61) receiving the mobile base (10) thereon and then being rotatable about the vertical axis, on command of the control unit; and, wherein the shunting element (6) includes a structural plane (67), arranged below the rotatable monorail profile (61), the structural plane resting on the support surface (202) and providing the mobile base (10) with a substantially level surface on which to move.

20. The system of claim 19, wherein the structural plane (67) has a lower layer (68) made of compressible polymer material having a high friction coefficient.

21. A system for moving and stabilizing a mobile base, which mobile base is part of a robotic handling unit (100) for moving objects in an automated shop or an automated warehouse (200) containing a plurality of storage units (201) for storing the objects, the mobile base having a platform (11) which supports devices for recognizing and handling the objects, the system comprising:

at least one modular linear guide element (5), which is mounted on a support surface (202) of the automated shop or the automated warehouse (200), and which guides the mobile base (10) along an operating trajectory which tracks with the plurality of storage units (201);

at least one rotatable shunting element (6), arranged on the support surface (202) at an end of the at least one modular linear guide element (5) and designed to reciprocally connect the at least one modular linear guide element with two or more additional linear guide elements (5), each additional linear guide element arranged at a predetermined angle relative to one another, the at least one rotatable shunting element receiving the mobile base thereon and being rotatably alignable with a selected linear guide element in order to shunt the mobile base (10) between the at least one modular linear guide element and the selected one of the two or more additional linear guide elements (5), or to enable the mobile base (10) to newly engage the at least one modular linear guide element at a different orientation thereto;

traction and positional control organs (20), arranged in a lower part of the mobile base (10), which convey the mobile base (10) along the linear guide elements (5) and the shunting element (6) for positioning the mobile base (10);

stabilizer devices (30), arranged peripherally in a lower part of the mobile base (10), which stabilize the position thereof during handling of the object by the robotic handling unit (100);

the mobile base (10) and shunting element (6) being controlled by a computerized control unit, which controls the positioning and stabilization of the mobile base according to operating requirements of the automated shop or the automated warehouse; and, wherein the traction and positional control organs (20) comprise:

a pair of drive wheels (21) which are mounted on the lower part of the mobile base (10) in symmetrical positions with respect to an axis of rotation of the mobile base (10);

at least one pair of guide wheels (23), mounted on the lower part of the mobile base (10) and operating in contact with lateral surfaces of an adjacent linear guide element (5), in order to maintain the position of the mobile base (10) relative thereto; and sensor means (25), electrically connected to the control unit for detecting a deviation of a position of the mobile base (10) from an optimal position thereof.

22. The system of claim 21, wherein each drive wheel is driven independently by position- and torque-controlled motors.

23. The system of claim 22, wherein each guide wheel (23) is rotatably mounted on a support (24) having a vertical axis, the support extending from the lower surface of the mobile base (10).

24. The system of claim 21, wherein two pairs of guide wheels (23) are provided, each pair being arranged with the guide wheels facing each other on opposite surfaces of the adjacent linear guide element (5), one pair being arranged at a front of the mobile base and the other pair being arranged at a rear of the mobile base (10).

25. The system of claim 24, wherein each guide wheel (23) is rotatably mounted on a support (24) having a vertical axis, the support extending from the lower surface of the mobile base (10).

26. The system of claim 21, wherein the sensor means (25) comprise at least one extensometer for each guide wheel for detecting deformation of each support.

* * * * *